US011519571B2

(12) United States Patent
Lu et al.

(10) Patent No.: US 11,519,571 B2
(45) Date of Patent: Dec. 6, 2022

(54) TRACK LIGHT WITH PHASE-SWITCHING DEVICE

(71) Applicant: Xiamen PVTECH Co., Ltd., Fujian (CN)

(72) Inventors: Fuxing Lu, Fujian (CN); Sishan Liao, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 33 days.

(21) Appl. No.: 17/314,015

(22) Filed: May 6, 2021

(65) Prior Publication Data

US 2022/0243880 A1 Aug. 4, 2022

(30) Foreign Application Priority Data

Feb. 1, 2021 (CN) ..... 202110137425.7

(51) Int. Cl.

| | |
|---|---|
| ***F21S 4/28*** | (2016.01) |
| ***H05B 47/10*** | (2020.01) |
| ***F21V 21/35*** | (2006.01) |
| ***F21V 23/00*** | (2015.01) |
| ***F21Y 103/00*** | (2016.01) |

(52) U.S. Cl.

CPC ..... *F21S 4/28* (2016.01); *F21V 21/35* (2013.01); *F21V 23/002* (2013.01); *H05B 47/10* (2020.01); *F21Y 2103/00* (2013.01)

(58) Field of Classification Search

CPC ..... F21V 21/35; F21V 23/002; F21V 23/04; F21S 4/28; H05B 47/10; H05B 47/155; H01H 13/64; H01H 23/28

USPC ..... 362/648, 219; 200/547, 519, 339

See application file for complete search history.

(56) References Cited

U.S. PATENT DOCUMENTS 4,876,422 A * 10/1989 Kanezawa ..... H01H 9/041 200/547

2021/0404636 A1* 12/2021 Béland ..... F21V 21/025

FOREIGN PATENT DOCUMENTS

| | | | | |
|---|---|---|---|---|
| CN | 103398351 A | * | 11/2013 | ..... F21S 8/06 |
| DE | 202018102994 U1 | * | 8/2018 | ..... F21V 21/005 |
| WO | WO-2022027824 A1 | * | 2/2022 | ..... F21S 8/06 |

* cited by examiner

*Primary Examiner* — Laura K Tso

(74) *Attorney, Agent, or Firm* — Winston Hsu

(57) ABSTRACT

A track light with phase-switching device includes a track assembly, a light source base, and a power module. The track assembly includes an installation base, a first side wall, and a second side wall. The first side wall and the second side wall are respectively disposed at opposite sides of the installation base. One end of the first side wall has a first fixation portion, and one end of the second side wall has a second fixation portion. The light source base is assembled with the track assembly. The light source base includes a heat dissipation base and a light source plate. The light source plate is located on the heat dissipation base. The power module includes wirings and a phase-switching device. The power module is electrically connected to the light source plate through the wirings. The phase-switching device is provided for switching a phase of the wirings.

7 Claims, 5 Drawing Sheets

TRACK LIGHT WITH PHASE-SWITCHING DEVICE

CROSS REFERENCE TO RELATED APPLICATION

This application claims priority of China application No. 202110137425.7, which was filed on Feb. 1, 2021, and is included herein by reference.

BACKGROUND OF THE INVENTION

1. Field of the Invention

The present invention relates to a track light, in particular to a track light with phase-switching device.

2. Description of the Prior Art

Track lights are commonly used in our daily lives. The main structure of an existing track light includes a track assembly, a light source base, and a light shield. For applying the track light in different fields, the track light may require to comply with the specification of different voltages and currents. However, existing track light has one power distribution mode, thus limiting the application variety of the track light.

Moreover, after several existing track lights are series-connected to one another to form a track light set, the whole track light set emits light or the whole track light set does not emit light. As a result, a function that only one or some of the track lights emit light and rest of the track lights do not emit light cannot be implemented. Thus, when the user only has to make parts of the track lights emit light, rest of the track lights still emit light. Consequently, the existing track light not only fails to meet the user's requirements but also consumes additional energy, which is not helpful for the environmental-friendly concern.

Therefore, how to address the issues is to be considered.

SUMMARY OF THE INVENTION

In view of these, in one embodiment, a track light with phase-switching device comprises a track assembly, a light source base, and a power module. The track assembly comprises an installation base, a first side wall, and a second side wall. The first side wall and the second side wall are respectively disposed at two opposite sides of the installation base. One end of the first side wall has a first fixation portion, and one end of the second side wall has a second fixation portion. The light source base is assembled with the track assembly. The light source base comprises a heat dissipation base and a light source plate. The light source plate is located on the heat dissipation base. The power module comprises a plurality of wirings and a phase-switching device. The power module is electrically connected to the light source plate through the wirings. The phase-switching device is provided for switching a phase of the wirings.

In one or some preferable implementations of the track light with phase-switching device, the wirings are divided into a plurality of live wires and a plurality of neutral wires. Two ends of the wirings are further defined as an input terminal and an output terminal. The phase-switching device comprises a phase-switching switch. The phase-switching switch is capable of being toggled or pressed so as to determine a connection mode between the live wires located at the output terminal and the live wires located at the input terminal.

In one or some preferable implementations of the track light with phase-switching device, the phase-switching device further comprises a housing and a base. The housing covers the base. The base comprises a front end portion and a rear end portion. The phase-switching switch is located between the front end portion and the rear end portion. The front end portion is connected to one of the neutral wires and one of the live wires, and the rear end portion is connected to one of the neutral wires and the live wires.

In one or some preferable implementations of the track light with phase-switching device, several track lights are series-connected to one another. Since the phase of each of the track lights can be set by the user in advance, the user can toggle or press the phase-switching switch to determine the track light with which phase is allowed to have electrical conduction. Therefore, the function that one or some of the track lights emit light but rest of the track lights do not emit light can be achieved.

In one or some preferable implementations of the track light with phase-switching device, a mating portion and an elastic connection portion are respectively disposed at two sides of the heat dissipation base. The mating portion is buckled with the first fixation portion, and the elastic connection portion abuts against the second fixation portion.

In one or some preferable implementations of the track light with phase-switching device, the track light further comprises a shield covering the heat dissipation base. Two first engaging portions are disposed at two opposite inner sides of the shield. Two second engaging portions are disposed on the heat dissipation base and correspond to the two first engaging portions. The two first engaging portions are respectively engaged with the two second engaging portions.

In one or some preferable implementations of the track light with phase-switching device, the track light further comprises a limiting member. A portion of the limiting member adjacent to the installation base extends toward the second fixation portion. The second side wall has a limiting portion corresponding to the limiting member. A limiting space is between the limiting member and the limiting portion. A limiting structure extends from one side of the heat dissipation base corresponding to the mating portion, and the limiting structure is provided for being inserted into the limiting space. The limiting structure at least comprises a first positioning portion corresponding to the limiting member and a second positioning portion corresponding to the limiting portion.

In one or some preferable implementations of the track light with phase-switching device, a hanging groove is between the first positioning portion and the second positioning portion.

In one or some preferable implementations of the track light with phase-switching device, a hanging structure extends from a portion of the second side wall adjacent to the second fixation portion, and the hanging structure is provided for hanging with the hanging groove.

In one or some preferable implementations of the track light with phase-switching device, the hanging structure comprises an extension wall laterally extending from the second side wall and a hanging wall extending from the extension wall toward the limiting member.

Based on the above, in the track light according to one or some embodiments, because the phase-switching device has the phase-switching switch, the phase of the live wires can be adjusted easily by toggling or pressing the phase-switching switch, thereby satisfying different power distribution requirements and improving problems in existing devices.

These and other objectives of the present invention will no doubt become obvious to those of ordinary skill in the art after reading the following detailed description of the preferred embodiment that is illustrated in the various figures and drawings.

DETAILED DESCRIPTION

The detailed description of the technical content, structural features, and the objects and effects of the technical solutions will be described in detail below with reference to the specific embodiments and the accompanying drawings.

Figure 1:
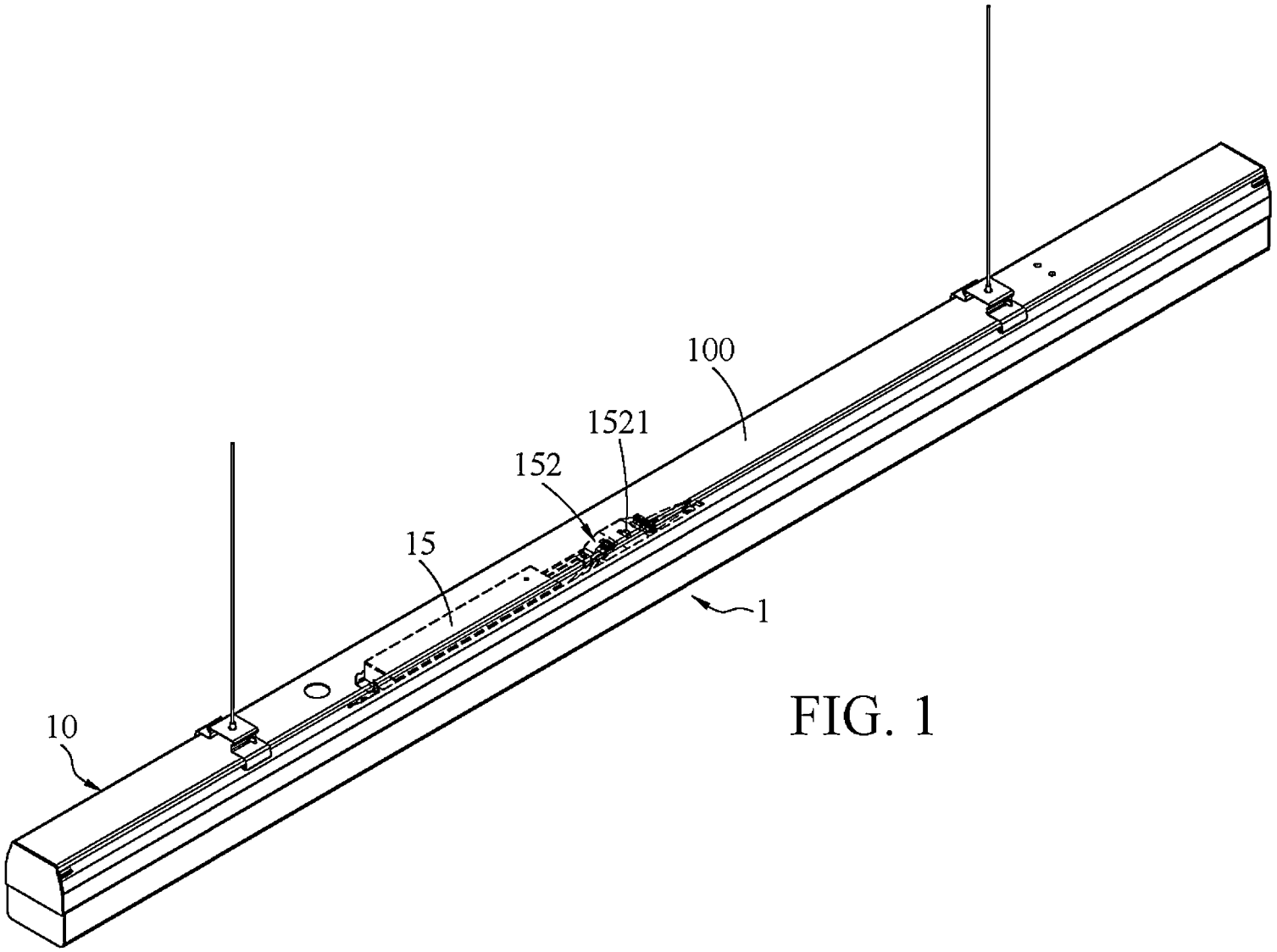
FIG. 1 illustrates a perspective view of a track light with phase-switching device according to an exemplary embodiment of the present invention.
Figure 2:
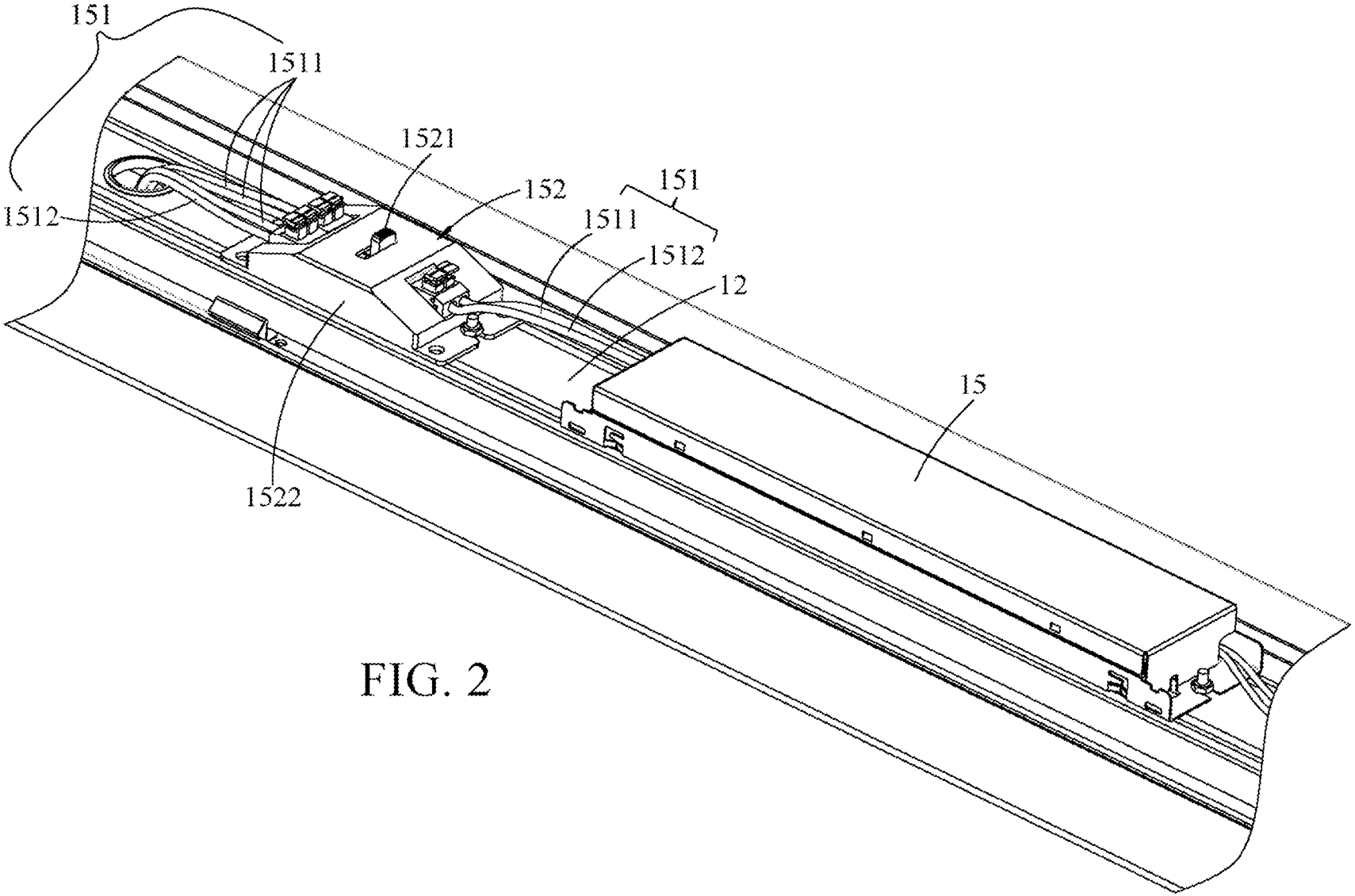
FIG. 2 illustrates a schematic view showing the relationship between the light source base and the phase-switching device of the track light with phase-switching device according to the exemplary embodiment.
Figure 3:
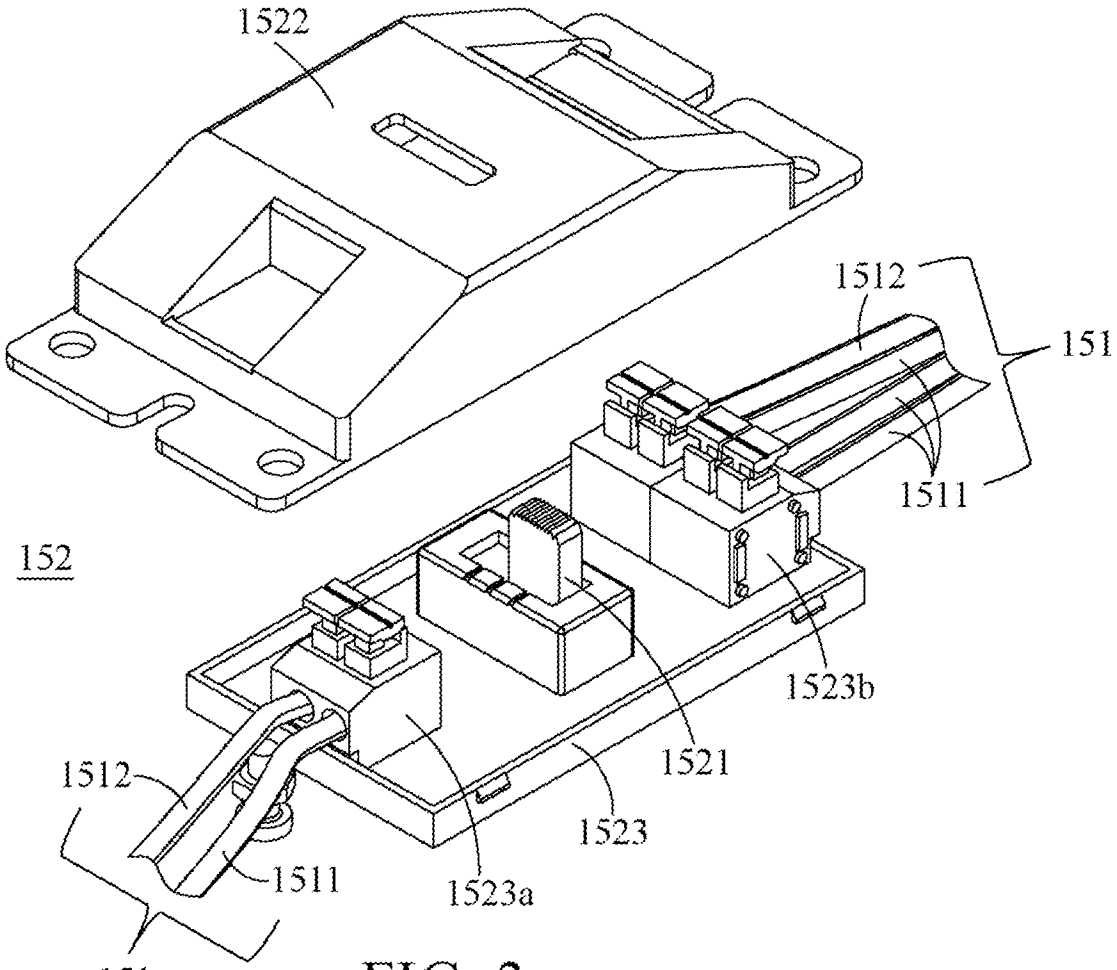
FIG. 3 illustrates an exploded view of the phase-switching device of the track light with phase-switching device according to the exemplary embodiment.

Please refer to FIGS. 1 to 3. FIG. 1 illustrates a perspective view of a track light with phase-switching device according to an exemplary embodiment of the present invention. FIG. 2 illustrates a schematic view showing the relationship between the light source base and the phase-switching device of the track light according to the exemplary embodiment. FIG. 3 illustrates an exploded view of the phase-switching device of the track light of the exemplary embodiment.

The track light with phase-switching device (the track light 1) comprises a track assembly 10, a light source base 12, and a power module 14.

The track assembly 10 comprises an installation base 100, a first side wall 101, and a second side wall 102. The first side wall 101 bends and extends from one of two sides of the installation base 100. The second side wall 102 bends and extends from the other side of the installation base 100, and the second side wall 102 corresponds to the first side wall 101. One end of the first side wall 101 comprises a first fixation portion 1010, and one end of the second side wall 102 comprises a second fixation portion 1020.

The light source base 12 is assembled with the track assembly 10. The light source base 12 comprises a heat dissipation base 126 and a light source plate 141, and the light source plate 141 is located on the heat dissipation base 126.

The power module 15 comprises a plurality of wirings 151 and a phase-switching device 152. The power module 15 is electrically connected to the light source plate 141 through the wirings 151. The phase-switching device 152 is provided for switching a phase of the wirings 151.

As shown in FIG. 2, in this embodiment, the wirings 151 are divided into a plurality of live wires 1511 and a plurality of neutral wires 1512, and two ends of the wirings 151 are further defined as an output terminal and an input terminal. The phase-switching device 152 comprises a phase-switching switch 1521. The phase-switching switch 1521 can be toggled or pressed to determine a connection mode between the live wires 1511 at the output terminal and the live wires 1511 at the input terminal. In the embodiment shown in FIG. 2, the output terminal has one live wire 1511 and one neutral wire 1512, and the input terminal has three live wires 1511 and one neutral wire 1512. By toggling or pressing the phase-switching switch 1521, the live wire 1511 located at the output terminal can be switched to be connected to any one of the live wires 1511 located at the input terminal, thereby meeting the user requirements upon the user tends to choose track lights with different light-emitting portions.

As shown in FIG. 3, in this embodiment, the phase-switching device 152 further comprises a housing 1522 and a base 1523. The housing 1522 covers the base 1523. The base 1523 comprises a front end portion 1523*a* and a rear end portion 1523*b*. The output terminal of the wirings 151 is located at the front end portion 1523*a*, and the input terminal of the wrings 151 is located at the rear end portion 1523*b*. The phase-switching switch 1521 is located between the front end portion 1523*a* and the rear end portion 1523*b*. As shown in FIG. 3, the front end portion 1523*a* is connected to one live wire 1511 and one neutral wire 1512, and the rear end portion 1523*b* is connected to one neutral wire 1512 and three live wires 1511. Here, the phase-switching switch 1521 has three phases, by toggling or pressing the phase-switching switch 1521, the live wire 1511 at the front end portion 1523*a* can be determined to be connected to one of the three live wires 1511 at the rear end portion 1523*b* (in a one-to-one connection). Therefore, portions of the lamp (the track light) emitting lights can be controlled to meet user requirements.

In other words, when several track lights 1 are series-connected to one another, the phase (the conduction positions) of each of the track lights 1 can be set by the user in advance. Therefore, the user can toggle or press the phase-switching switch 1521 to determine the track light 1 with which phase (which conduction position) is allowed to have electrical conduction. Therefore, the function that one or some of the track lights 1 emit light but rest of the track lights 1 do not emit light can be achieved.

Figure 4:
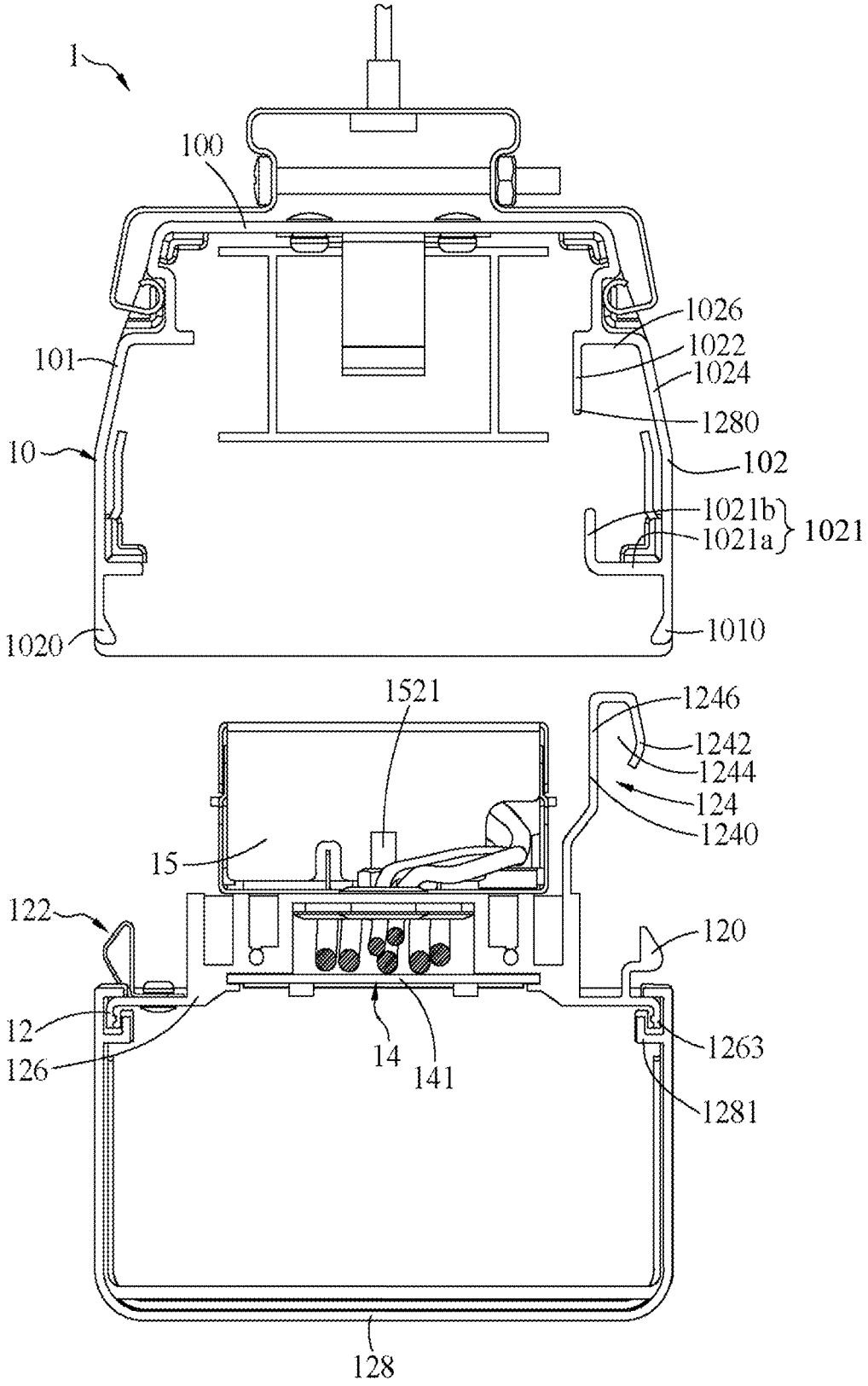
FIG. 4 illustrates an exploded view from a side perspective of the track light shown in FIG. 1.
Figure 5:
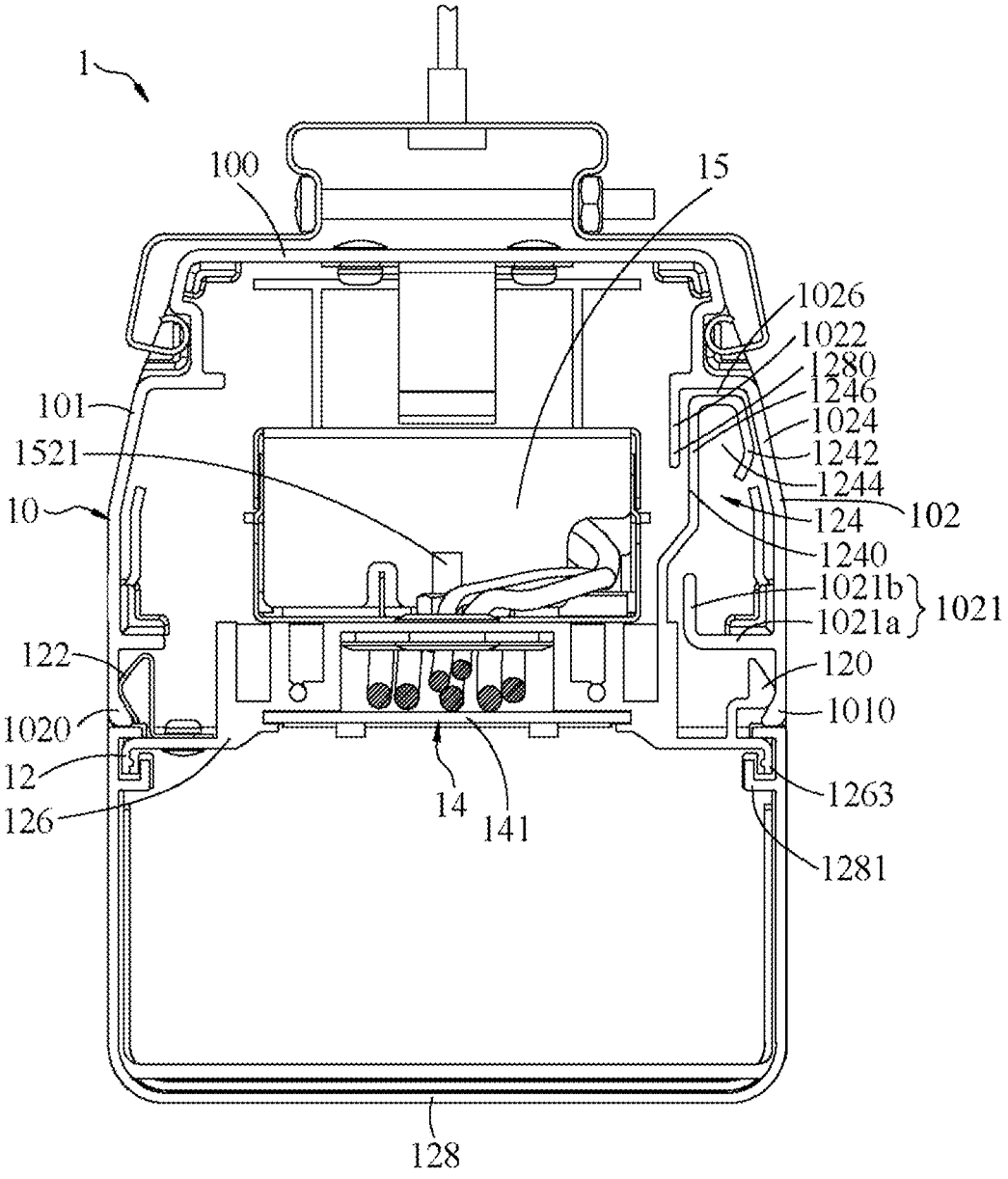
FIG. 5 illustrates a schematic assembled view of the track light shown in FIG. 4.

Please refer to FIGS. 4 and 5. FIG. 4 illustrates an exploded view from a side perspective of the track light shown in FIG. 1, and FIG. 5 illustrates a schematic assembled view of the track light shown in FIG. 4.

In this embodiment, a mating portion 120 and several elastic connection portions 122 are respectively disposed at two sides of the heat dissipation base 126. The number of the elastic connection portions 122 are plural. The mating portion 120 is buckled with the first fixation portion 1010, and the elastic connection portions 122 abut against the second fixation portion 1020.

The light source base 12 further comprises a shield 128. The shield 128 covers the heat dissipation base 126. Two first engaging portions 1281 are disposed at two opposite inner sides of the shield 128. Two second engaging portions 1263 are disposed on the heat dissipation base 126 and correspond to the two first engaging portions 1281. The two first engaging portions 1281 are respectively engaged with the second engaging portions 1263, thus providing fixation between the heat dissipation base 126 and the shield 128.

In this embodiment, a limiting member 1022 extends from a portion of the second side wall 102 adjacent to the installation base 100 toward the second fixation portion 1020, and the second side wall 102 has a limiting portion 1024 corresponding to the limiting member 1022. A limiting space 1026 is between the limiting member 1022 and the limiting portion 1024. Moreover, a limiting structure 124 extends from one side of the heat dissipation base 126 corresponding to the mating portion 120, and the limiting structure 124 is provided for being inserted into the limiting space 1026. The limiting structure 124 at least comprises a first positioning portion 1240 corresponding to the limiting member 1022 and a second positioning portion 1242 corresponding to the limiting portion 1024.

An end portion of the limiting member comprises a first straight portion 1280. The first positioning portion 1240 further comprises a second straight portion 1246 corresponding to the first straight portion 1280. Through the guiding of the first straight portion 1280 and the second straight portion 1246, the limiting structure 124 can be inserted into the limiting space 1026 properly, thus allowing a proper contact between the limiting structure 124 and the limiting space 1026, without leading damage issues caused by single-point contact configuration.

A hanging groove 1244 is between the first positioning portion 1240 and the second positioning portion 1242. A hanging structure 1021 extends from a portion of the second side wall 102 adjacent to the second fixation portion 1020, and the hanging structure 1021 is provided for hanging with the hanging groove 1244. The hanging structure 1021 comprises an extension wall 1021*a* laterally extending from the second side wall 102 and a hanging wall 1021*b* extending from the extension wall 1021*a* toward the limiting member 1022.

The hanging groove 1244 disposed on the limiting structure 124 of the light source base 12 corresponds to the hanging structure 1021 extending from a portion of the second side wall 102 adjacent to the second fixation portion 1020. Hence, when the track assembly 10 is not buckled with the light source base 12 completely, through the hanging between the hanging groove 1244 and the handing structure 1021 extending from a portion of the second side wall 102 adjacent to the second fixation portion 1020, the track assembly 10 is not detached from the light source base 12, thus preventing danger issues.

As above, in the track light according to one or some embodiments, because the phase-switching device has the phase-switching switch, the phase of the live wires can be adjusted easily by toggling or pressing the phase-switching switch, thereby satisfying different power distribution requirements and light-emitting requirements as well as improving problems in existing devices.

Although particular embodiments of the invention have been described in detail for purposes of illustration, various modifications and enhancements may be made without departing from the spirit and scope of the invention. Accordingly, the invention is not to be limited except as by the appended claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A track light with phase-switching device, comprising:

a track assembly comprising an installation base, a first side wall, and a second side wall, wherein the first side wall and the second side wall are respectively disposed at two opposite sides of the installation base, wherein one end of the first side wall has a first fixation portion, and one end of the second side wall has a second fixation portion;

a light source base assembled with the track assembly, wherein the light source base comprises a heat dissipation base and a light source plate, and the light source plate is located on the heat dissipation base, wherein a mating portion and an elastic connection portion are respectively disposed at two sides of the heat dissipation base, the mating portion engages with the first fixation portion, and the elastic connection portion abuts against the second fixation portion;

a power module comprising a plurality of wirings and a phase-switching device, wherein the power module is electrically connected to the light source plate through the wirings, and the phase-switching device is provided for switching a phase of the wirings; and a limiting member, wherein a portion of the limiting member adjacent to the installation base extends toward the second fixation portion, and the second side wall has a limiting portion corresponding to the limiting member, wherein a limiting space is between the liming member and the limiting portion, wherein a limiting structure extends from one side of the heat dissipation base corresponding to the mating portion, and the limiting structure is provided for being inserted into the limiting space, and wherein the limiting structure at least comprises a first positioning portion corresponding to the limiting member and a second positioning portion corresponding to the limiting portion.

2. The track light with phase-switching device according to claim 1, wherein the wirings are divided into a plurality of live wires and a plurality of neutral wires, three of the live wires and one of the neural wires serve as an input terminal, one of the live wires and one of the neural wires serve as an output terminal, the phase-switching device comprises a phase-switching switch, the phase-switching switch is capable of being toggled or pressed so as to determine a connection mode between the live wires located at the output terminal and the live wires located at the input terminal.

3. The track light with phase-switching device according to claim 2, wherein the phase-switching device further comprises a housing and a base, the housing covers the base, the base comprises a front end portion and a rear end portion, the phase-switching switch is located between the front end portion and the rear end portion, the front end portion is connected to one of the neutral wires and one of the live wires, and the rear end portion is connected to one of the neutral wires and the live wires.

4. The track light with phase-switching device according to claim 1, further comprising a shield covering the heat dissipation base, wherein two first engaging portions are disposed at two opposite inner sides of the shield, two second engaging portions are disposed on the heat dissipation base and correspond to the two first engaging portions, and the two first engaging portions are respectively engaged with the two second engaging portions.

5. The track light with phase-switching device according to claim 1, wherein a hanging groove is between the first positioning portion and the second positioning portion.

6. The track light with phase-switching device according to claim 5, wherein a hanging structure extends from a portion of the second side wall adjacent to the second fixation portion, and the hanging structure is provided for hanging with the hanging groove.

7. The track light with phase-switching device according to claim 6, wherein the hanging structure comprises an extension wall laterally extending from the second side wall and a hanging wall extending from the extension wall toward the limiting member.

* * * * *